US011225272B2

(12) United States Patent
Wike et al.

(10) Patent No.: US 11,225,272 B2
(45) Date of Patent: Jan. 18, 2022

(54) RAILWAY TRUCK ASSEMBLY HAVING I-BEAM COMPONENTS

(71) Applicant: Amsted Rail Company, Inc., Chicago, IL (US)

(72) Inventors: Paul Steven Wike, St. Louis, MO (US); Jay P. Monaco, Glen Carbon, IL (US); Joshua E. Tonnies, Damiansville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 325 days.

(21) Appl. No.: 16/509,658

(22) Filed: Jul. 12, 2019

(65) Prior Publication Data

US 2020/0017127 A1 Jan. 16, 2020

Related U.S. Application Data

(60) Provisional application No. 62/698,358, filed on Jul. 16, 2018.

(51) Int. Cl.
*B61F 5/52* (2006.01)
*B61F 3/02* (2006.01)

(52) U.S. Cl.
CPC . *B61F 5/52* (2013.01); *B61F 3/02* (2013.01)

(58) Field of Classification Search
CPC ..... B61F 5/52; B61F 3/02
See application file for complete search history.

(56) References Cited

U.S. PATENT DOCUMENTS

| | | | | | |
|---|---|---|---|---|---|
| 595,617 | A * | 12/1897 | Gallagher | B61F 5/52 105/202 |
| 1,757,388 | A * | 5/1930 | Rendleman | E04C 3/06 52/837 |
| 5,410,968 | A * | 5/1995 | Hawthorne | B61F 5/52 105/206.1 |
| 5,546,869 | A * | 8/1996 | Nassar | B61F 5/52 105/206.1 |
| 2020/0017128 | A1* | 1/2020 | Wike | B61F 5/52 |

FOREIGN PATENT DOCUMENTS

| | | | | |
|---|---|---|---|---|
| EP | 3119658 | 1/2017 | | |
| GB | 1415331 | 11/1975 | | |
| GB | 1415331 | A * | 11/1975 | E06C 7/085 |

OTHER PUBLICATIONS

International Search Report and Written Opinion for PCT/US2019/041528, dated Oct. 17, 2019.

* cited by examiner

*Primary Examiner* — Jason C Smith
(74) *Attorney, Agent, or Firm* — The Small Patent Law Group LLC; Joseph M. Butscher

(57) ABSTRACT

A truck assembly is configured to travel along a track having rails, and includes a first side frame, a second side frame, and a bolster extending between the first side frame and the second side frame. One or more of the first side frame, the second frame, or the bolster includes at least a portion formed as an I-beam that includes a web having a first end and a second end opposite from the first end, a first flange extending from the first end of the web, and a second flange extending from the second end of the web. A thickness of the web increases away from a first neutral axis towards the first flange and the second flange.

17 Claims, 7 Drawing Sheets

RAILWAY TRUCK ASSEMBLY HAVING I-BEAM COMPONENTS

RELATED APPLICATIONS

This application relates to and claims priority benefits from U.S. Provisional Patent Application No. 62/698,358, filed Jul. 16, 2018, which is hereby incorporated by reference in its entirety.

FIELD OF THE DISCLOSURE

Embodiments of the present disclosure generally relate to truck assemblies for rail vehicles, such as rail cars, and, more particularly, to truck assemblies that include one or more components having at least portions formed as I-beams.

BACKGROUND OF THE DISCLOSURE

Rail vehicles travel along railways, which have tracks that include rails. A rail vehicle includes one or more truck assemblies that support one or more car bodies. Each truck assembly includes two side frames and a bolster. Friction shoes are disposed between the bolster and the side frames. The friction shoes are configured to provide damping for suspension.

Typically, at least the side frames are formed having a hollow box or tubular construction. Risers, runners, and other such structures are used during the manufacturing process to form the side frames. Further, the side frames are supported with rigging during the manufacturing process. In general, the process of forming the side frames is time- and labor-intensive, as well as costly.

Certain side frames have been formed with a tapering I-beam construction. Such side frames are rigid in the vertical direction, but are susceptible to twisting when a transverse load is exerted therein.

An I-shaped cross section is an efficient form for carrying both bending and shear loads in a plane of a web. However, the cross-section also has a reduced capacity in the transverse direction, and, as noted, is inefficient in relation transverse loads. As vertical force is exerted, a traditional I-beam deflects in a vertical plane. However, with the addition of transverse force, the traditional I-beam may bend out of the vertical plane, and cause the traditional I-beam to buckle and/or twist.

Accordingly, side frames of railway truck assemblies are typically formed as hollow box or tubes, in contrast to I-beams. As noted, however, the process of forming hollow box or tubular side frames is time- and labor-intensive, as well as costly.

SUMMARY OF THE DISCLOSURE

A need exists for a railway truck assembly having components that may be efficiently formed. Further, a need exists for a railway truck assembly having components that are robust and reliable. Moreover, a need exists for an I-beam that efficiently carries bending and shear loads in a plane of a web, as well as an increased capacity in a transverse direction.

With those needs in mind, certain embodiments of the present disclosure provide an I-beam including a web having a first end and a second end opposite from the first end, a first flange extending from the first end of the web, and a second flange extending from the second end of the web. A thickness of the web increases away from a first neutral axis towards the first flange and the second flange. The thickness of the web may uniformly increase from the first neutral axis towards the first flange and the second flange. In at least one embodiment, the web at the first neutral axis is a thinnest portion of the web.

In at least one embodiment, a thickness of the first flange increases away from a second neutral axis towards first distal edges of the first flange. The first neutral axis may be orthogonal to the second neutral axis. In at least one embodiment, the first flange at the second neutral axis is a thinnest portion of the first flange.

In at least one embodiment, a thickness of the second flange increases away from the second neutral axis towards second distal edges of the second flange. In at least one embodiment, the second flange at the second neutral axis is a thinnest portion of the second flange.

Certain embodiments of the present disclosure provide a method of forming an I-beam. The method includes extending a first flange from a first end of a web, extending a second flange from a second end of the web (wherein the second end is opposite from the first end), and increasing a thickness of the web away from a first neutral axis towards the first flange and the second flange.

In at least one embodiment, the method also includes a thickness of the first flange away from a second neutral axis towards first distal edges of the first flange. In at least one embodiment, the method also includes increasing a thickness of the second flange away from the second neutral axis towards second distal edges of the second flange.

Certain embodiments of the present disclosure provide a truck assembly that is configured to travel along a track having rails. The truck assembly includes a first side frame, a second side frame, and a bolster extending between the first side frame and the second side frame. One or more of the first side frame, the second frame, or the bolster includes at least a portion formed as an I-beam, as described herein.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide an I-beam including a web coupled to at least one flange. A thickness of the web outwardly expands away from a first neutral axis. That is, the thickness outwardly expands away from the first neutral axis. Further, a thickness of the flange(s) outwardly expands from a second neutral axis, which may be orthogonal to the first neutral axis. In at least one embodiment, a truck assembly has one or more components having at least portions formed as I-beams that outwardly expand (for example, increase in thickness) away from at least one neutral axis.

The outward expansion of portions of the I-beam away from a neutral axis distributes stresses over larger areas. As such, the stresses may be evenly and uniformly distributed throughout the I-beam, instead of being variably exerted at different locations. In this manner, the I-beam may be a constant stress I-beam. Components (such as side frames and bolsters) of railway truck assemblies formed of such I-beams evenly and uniformly distribute stresses therethrough. The components outwardly expand (that is, increase in thickness) away from at least one neutral axis, thereby effectively and efficiently withstanding vertical and transverse forces that may otherwise twist traditional I-beams.

Typically, when loads are exerted into an I-beam, compressive and tensile forces are developed. The compressive and tensile forces induce stresses into the beam. A maximum compressive stress may be at an upper most edge of the I-beam while a maximum tensile stress may be located at a lower most edge of the I-beam. Because the stresses between such opposing stresses is linear, there is a point on the linear path between them where there is no bending stress, which is known as a neutral axis.

The neutral axis within a cross-section of a beam is an axis in which there are no longitudinal stresses or strains. Stated differently, the neutral axis is a line in a beam or other such structure subjected to bending in which fibers are neither stretched, nor compressed, or where the longitudinal stress is zero.

Figure 1:
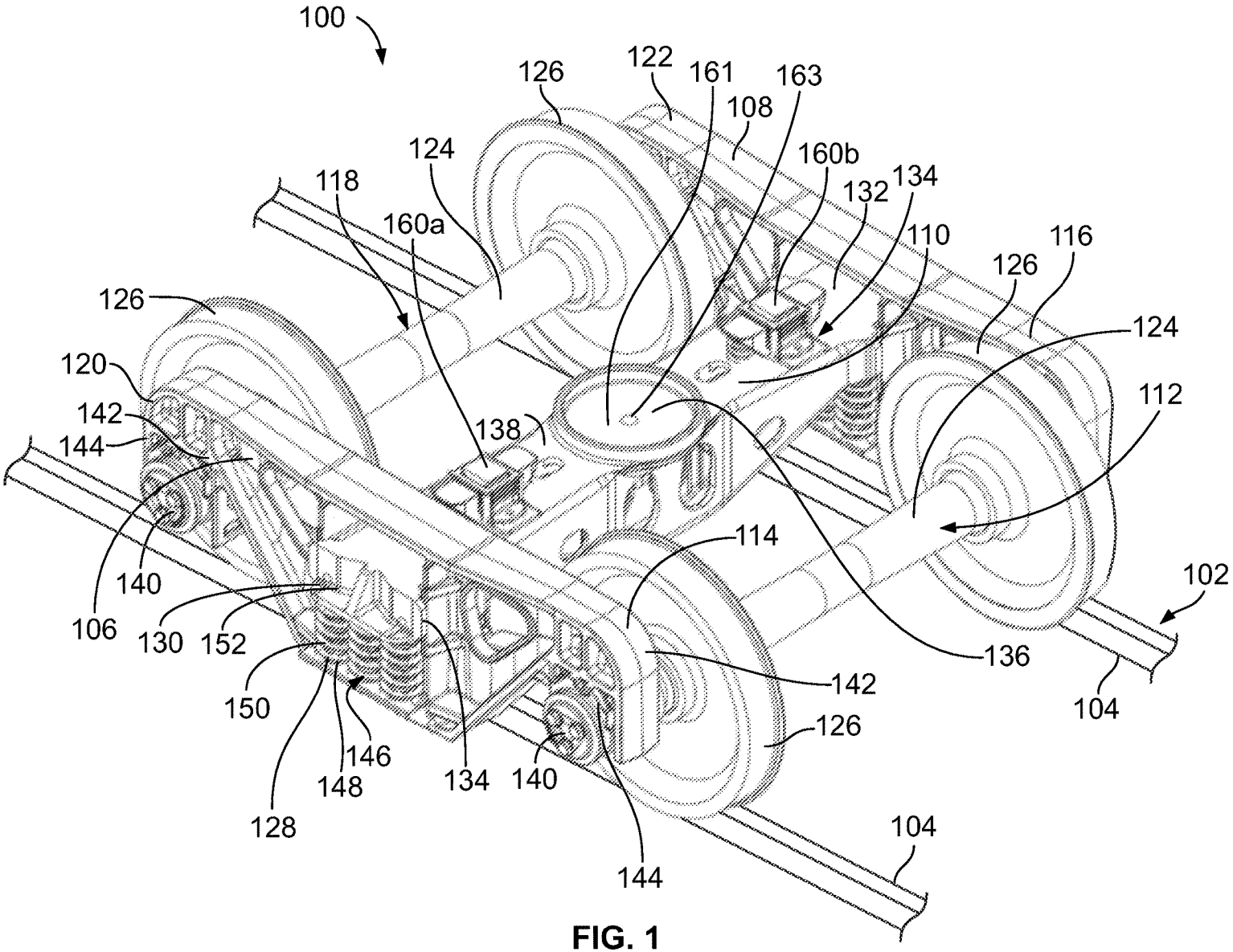
FIG. 1 illustrates a perspective top view of a truck assembly.

FIG. 1 illustrates a perspective top view of a truck assembly 100. The truck assembly 100 is configured to travel along a track 102 having rails 104. The truck assembly 100 includes a first side frame 106 and a second side frame 108, which are spaced apart from one another. A bolster 110 extends between the first side frame 106 and the second side frame 108, and couples the first side frame 106 to the second side frame 108.

A first wheel set 112 is rotatably coupled to first ends 114 and 116 of the first side frame 106 and the second side frame 108, respectively, and a second wheel set 118 is rotatably coupled to second ends 120 and 122 of the first side frame 106 and the second side frame 108, respectively. Each of the first and second wheel sets 112 and 118 includes an axle 124 connected to wheels 126. The wheels 126 are supported on the rails 104 and are configured to travel thereon as the axles 124 rotate in relation to the first side frame 106 and the second side frame 108.

The first and second side frames 106 and 108 includes damper systems 128. For example, the damper systems 128 include one or more springs, friction shoes, and the like that are configured to dampen forces exerted into and/or by the truck assembly 100 as the truck assembly 100 travels along the track 102.

The bolster 110 includes ends 130 and 132 (for example a first end 130 and an opposite second end 132), which extend through openings 134 of the side frames 106 and 108. The bolster 110 also includes a bolster center bowl 136 outwardly extending from an upper surface 138. As shown, the bolster center bowl 136 is centrally located on the upper surface 138 of the bolster 110 between the ends 130 and 132.

Ends of the axles 124 are rotatably retained by bearings 140, which are coupled to the side frames 106 and 108. In particular, the wheel sets 112 and 118 are coupled to the side frames 106 and 108 at pedestals 142 of the side frames 106 and 108. The pedestals 142 connect to bearing adapters 144 that connect to the bearings 140.

In at least one embodiment, the damping systems 128 include spring groups 146 supported within the openings 134 of the side frames 106 and 108. The spring groups 146 include load coils 148 and control coils 150. The load coils 148 support the bolster 110 at the ends 130 and 132. The control coils 150 support friction shoes 152.

A side bearing assembly 160*a* is mounted on the top surface 138 of the bolster 110 between the bolster center bowl 136 and the end 130. A second side bearing assembly 160*b* is mounted on the top surface 138 of the bolster 110 between the bolster center bowl 136 and the end 132. The side bearing assembly 160*a* and the side bearing assembly 160*b* may be aligned along a central longitudinal plane 161 of the bolster 110 that passes through a center 163 of the bolster center bowl 136. Each side bearing assembly 160*a* and 160*b* may be spaced from the center 163 the same distance, but in opposite directions.

The side bearing assemblies 160*a* and 160*b* are configured to limit roll of a car body supported by the truck assembly 100, thereby increasing the stability of the car body and the truck assembly 100, as well as a rail vehicle that includes the car body and the truck assembly 100.

In at least one embodiment, one or more portions of a truck assembly, such as the truck assembly 100, are formed as I-beams that outwardly expand (that is, increase in thickness) away from at least one neutral axis. For example, one or both of the first side frame 106 and/or the second side frame 108 may have at least portions formed as I-beams that outwardly expand away from at least one neutral axis. As another example, the bolster 110 may have at least a portion formed as an I-beam that outwardly expands away from at least one neutral axis. Alternatively, portions of the truck assembly may be formed as I-beams that may not outwardly expand away from at least one neutral axis.

Figure 2:
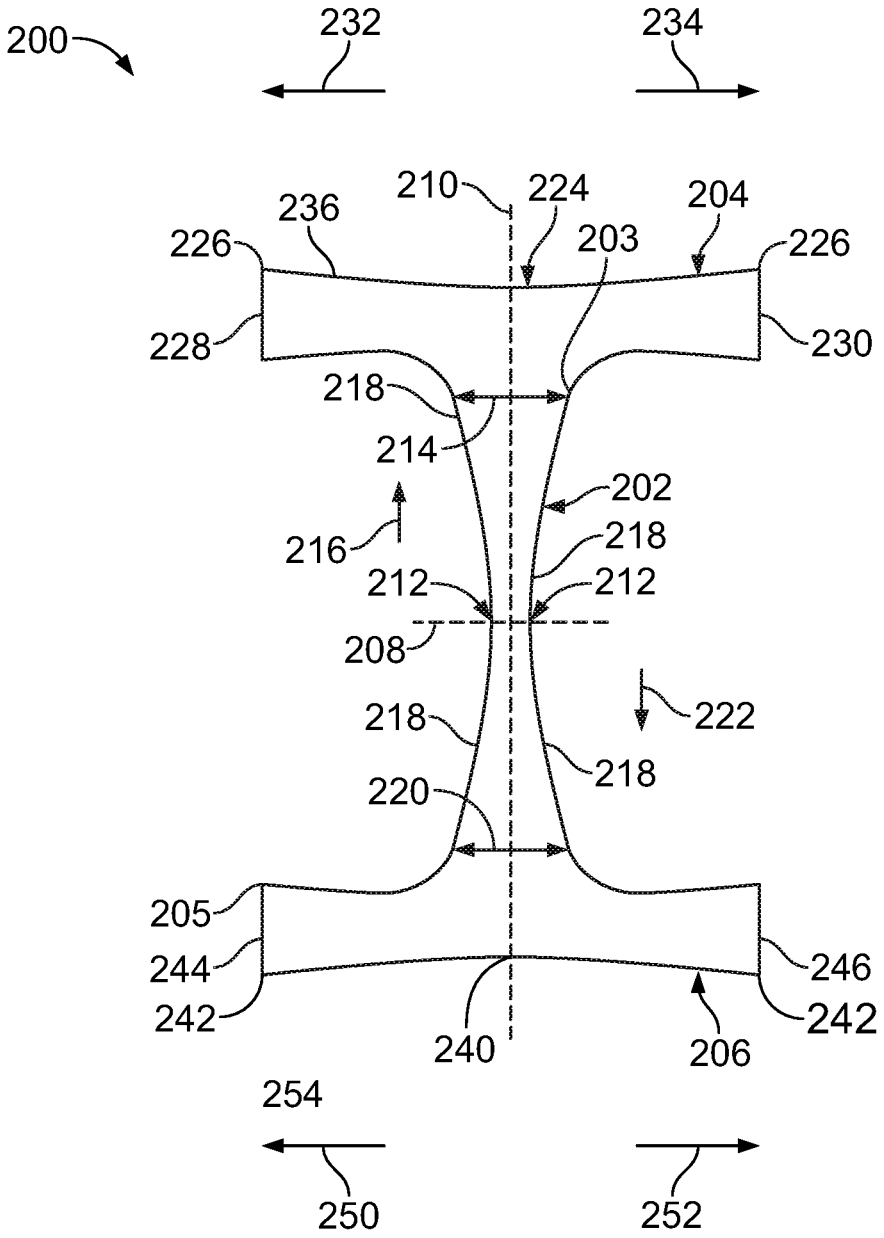
FIG. 2 illustrates an end view of an I-beam, according to an embodiment of the present disclosure.

FIG. 2 illustrates an end view of an I-beam 200, according to an embodiment of the present disclosure. The I-beam 200 includes a web 202 integrally formed with a first (or upper) flange 204 and a second (or lower) flange 206. The first flange 204 extends from a first end 203 of the web 202, and the second flange 206 extends from the second end 205 of the web 202. The first end 203 and the second end 205 are opposite from one another. A first neutral axis 208 extends through the web 202. The first neutral axis 208 may be a central transverse or horizontal axis of the I-beam 200. The first neutral axis 208 is a transverse axis or neutral axis X.

As shown, the first neutral axis 208 may be horizontally-oriented with respect to the orientation of the I-beam shown in FIG. 2.

A second neutral axis 210 extends through the first flange 204, the web 202, and the second flange 206. The second neutral axis 210 may be a central vertical axis of the I-beam 200. The second neutral axis 210 is a vertical axis or neutral axis Y. The first neutral axis 208 may be orthogonal to the second neutral axis 210. The first neutral axis 208 and the second neutral axis 210 may intersect within the web 202.

The web 202 outwardly expands away from the first neutral axis 208. That is, the thickness of the web 202 increases with increased distance from the first neutral axis 208. The thickness 212 of the web 202 at the first neutral axis 208 is minimal or otherwise reduced. The thickness 214 of the web 202 proximate to the first flange 204 is greater than the thickness 212. The thickness of the web 202 away from the first neutral axis 208 towards the first flange 204 in the direction of arrow 216 increases. As such, the web 202 outwardly flares or otherwise expands away from the first neutral axis 208 towards the first flange 204. In at least one embodiment, the thickness of the web 202 away from the first neutral axis 208 towards the first flange 204 may gradually, regularly, and uniformly increase. For example, the outer lateral surfaces 218 may have a constant outward slope or curvature away from the first neutral axis 208 towards the first flange 204. The thickness of the web 202 uniformly increases from the first neutral axis 208 to the first flange 204.

Similarly, the thickness 220 of the web 202 proximate to the second flange 206 is greater than the thickness 212. The thickness of the web 202 away from the first neutral axis 208 towards the second flange 206 in the direction of arrow 222 increases. As such, the web 202 outwardly flares or otherwise expands away from the first neutral axis 208 towards the second flange 206. In at least one embodiment, the thickness of the web 202 away from the first neutral axis 208 towards the second flange 206 may gradually, regularly, and uniformly increase. For example, the outer lateral surfaces 218 may have a constant outward slope or curvature away from the first neutral axis 208 towards the second flange 206. The thickness of the web 202 uniformly increases from the first neutral axis 208 to the second flange 206.

In at least one embodiment, the thicknesses 214 and 220 may be the same. Alternatively, the thickness 214 may be greater or less than the thickness 220.

The first flange 204 outwardly expands away from the second neutral axis 210. That is, the thickness of the first flange 204 increases with increased distance from the second neutral axis 210. The thickness 224 of the first flange 204 at the second neutral axis 210 is minimal or otherwise reduced. The thickness 226 of the first flange 204 at distal edges 228 and 230 is greater than the thickness 224. The thickness of the first flange 204 away from the second neutral axis 210 towards the distal edges 228 and 230 in the directions of respective arrows 232 and 234 increases. As such, the first flange 204 outwardly flares or otherwise expands away from the second neutral axis 210 towards the distal edges 228 and 230. In at least one embodiment, the thickness of the first flange 204 away from the second neutral axis 210 towards the distal edges 228 and 230 may gradually, regularly, and uniformly increase. For example, the exposed surfaces 236 of the first flange 204 may have a constant outward slope or curvature away from the second neutral axis 210 towards the distal edges 228 and 230. The thickness of the first flange uniformly increases from the second neutral axis 210 to the distal edges 228 and 230.

Similarly, the second flange 206 outwardly expands away from the second neutral axis 210. That is, the thickness of the second flange 206 increases with increased distance from the second neutral axis 210. The thickness 240 of the second flange 206 at the second neutral axis 210 is minimal or otherwise reduced. The thickness 242 of the second flange 206 at distal edges 244 and 246 is greater than the thickness 240. The thickness of the second flange 206 away from the second neutral axis 210 towards the distal edges 244 and 246 in the directions of respective arrows 250 and 252 increases. As such, the second flange 206 outwardly flares or otherwise expands away from the second neutral axis 210 towards the distal edges 244 and 246. In at least one embodiment, the thickness of the first flange 206 away from the second neutral axis 210 towards the distal edges 244 and 246 may gradually, regularly, and uniformly increase. For example, the exposed surfaces 254 of the second flange 206 may have a constant outward slope or curvature away from the second neutral axis 210 towards the distal edges 244 and 246. The thickness of the second flange uniformly increases from the second neutral axis 210 to the distal edges 244 and 246.

In at least one embodiment, the thicknesses 226 and 242 may be the same. Alternatively, the thickness 226 may be greater or less than the thickness 242.

As described, the I-beam 200 includes the web 202 having the first end 203 and the second end 205 opposite from the first end 203. The first flange 204 extends from the first end 203 of the web 202. The second flange 206 extends from the second end 205 of the web 202. The thickness of the web 202 increases away from the first neutral axis 208 towards the first flange 204 and the second flange 206. The web 202 at the first neutral axis 208 is the thinnest portion of the web 202. In at least one embodiment, a thickness of the first flange 204 increases away from the second neutral axis 210 towards first distal edges 228 and 230 of the first flange 204. The first flange 204 at the second neutral axis 210 is the thinnest portion of the first flange 204. In at least one embodiment, a thickness of the second flange 206 increases away from the second neutral axis 210 towards second distal edges 244 and 246 of the second flange 206. The second flange 206 at the second neutral axis 210 is the thinnest portion of the second flange 206.

The I-beam 200 may be integrally molded and formed. For example, the I-beam 200 may be integrally molded and formed as a single piece of diecast metal, such as steel, aluminum, iron, copper, or the like.

The I-beam 200 is a constant stress I-beam that has a non-uniform thickness along various axes. In contrast, a traditional I-beam having a constant thickness may not efficiently distribute forces, such as caused by stresses and strains. As force moves away from the neutral axes, the force increases along with the stress in the material. Embodiments of the present disclosure provide I-beam construction, such as the I-beam 200, having an outwardly expanding thickness away from one or more neutral axes, which distributes force at a constant rate throughout the I-beam 200. In at least one embodiment, the force is distributed by outwardly flaring or otherwise expanding (for example, increasing thickness) the material area at an even rate away from the first neutral axis 208 and the second neutral axis 210 towards outer extremities of the I-beam 200. Increasing thickness away from the first neutral axis 208 and/or the second neutral axis 210 distributes the force evenly over the sections, which also evenly distributes the stress of the material.

Increasing the thickness of the I-beam in the transverse direction away from a neutral axis such that out of vertical plane bending does not occur inhibits, prevents, or otherwise reduces buckling and twisting. Because the thickness and cross-sectional area of the I-beam increases in directions away from the neutral axes, the overall area and volume of the I-beam is increased, and stress exerted onto and/or into the I-beam is therefore distributed over a larger area. Consequently, the stress over the larger area is decreased.

Referring to FIGS. 1 and 2, certain components of the truck assembly 100 may have at least portions formed as at least portions of the I-beam 200. For example, one or both of the first side frame 106 or the second side frame 108 may have one or more portions formed as the I-beam 200. As another example, the bolster 110 may have one or more portions formed as the I-beam 200.

Figure 3:
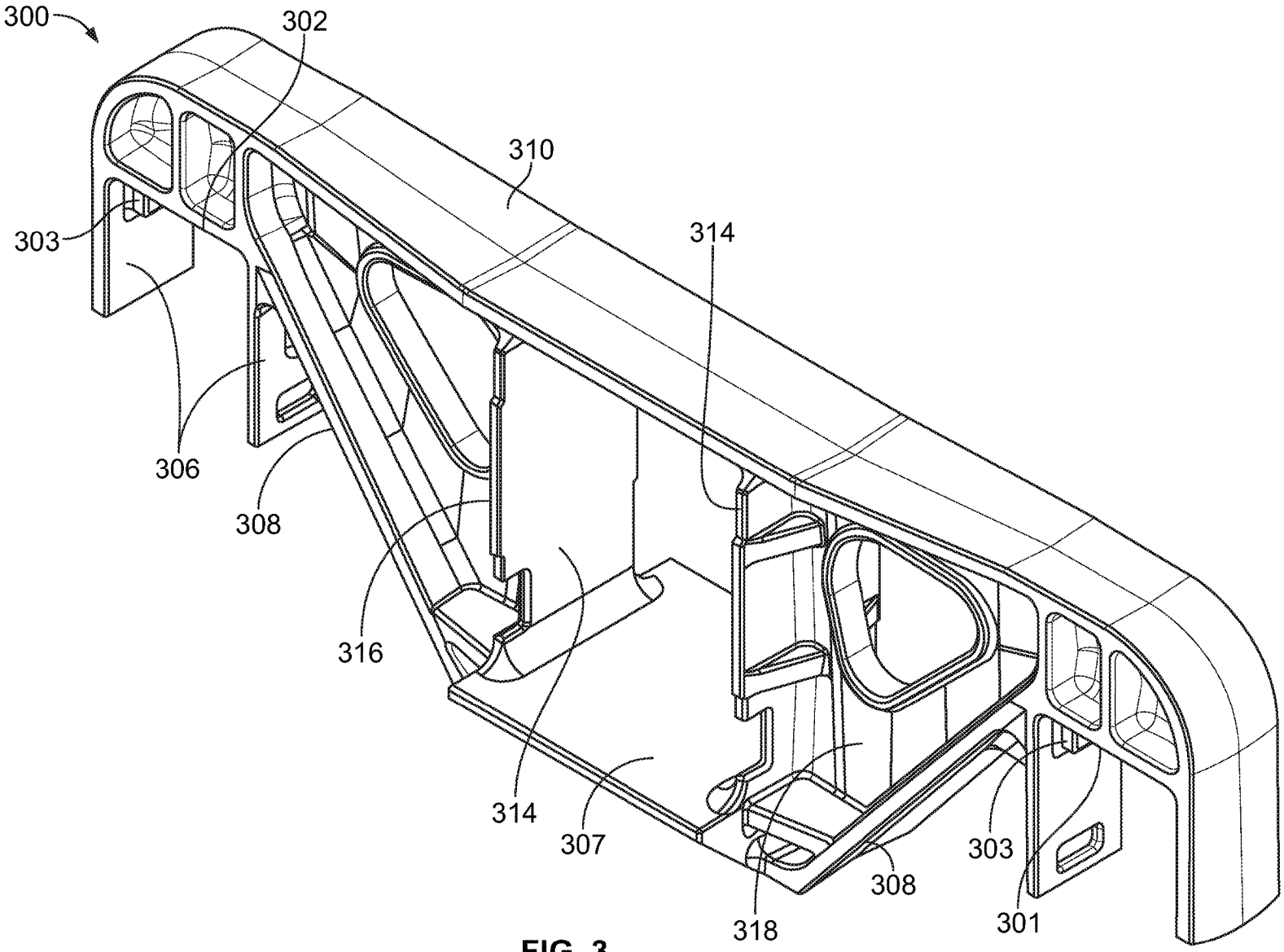
FIG. 3 illustrates a perspective top view of a side frame, according to an embodiment of the present disclosure.

FIG. 3 illustrates a perspective top view of a side frame 300, according to an embodiment of the present disclosure. Referring to FIGS. 1 and 3, one or both of the first side frame 106 or the second side frame 108 may be formed as the side frame 300. The side frame 300 may replace an existing side frame of tuck assembly.

The side frame 300 has pedestals 301, which include lugs 303 and jaws 306 configured to mate with components, such as wheel assemblies. Outwardly-flared (that is, away from neutral axes, as described herein) tension members 308 and outwardly-flared compression members 310 fit within a same envelope as a traditional side frame. A spring nest 307 is configured to retain load and control coils. Columns 314 may support wear plates or may be plasma coated with a wear resistant material. Sides of the columns 314 provide bolster lugs 316, which are protruding surfaces that interface with the bolster and keep the side frames in place. The side frame 300 also includes outwardly-flared (that is, away from one or more neutral axes) webs 318 that increase in thickness, as described with respect to FIG. 2, to uniformly distribute stress in relation to the tension members 308 and the compression members 310.

Figure 4:
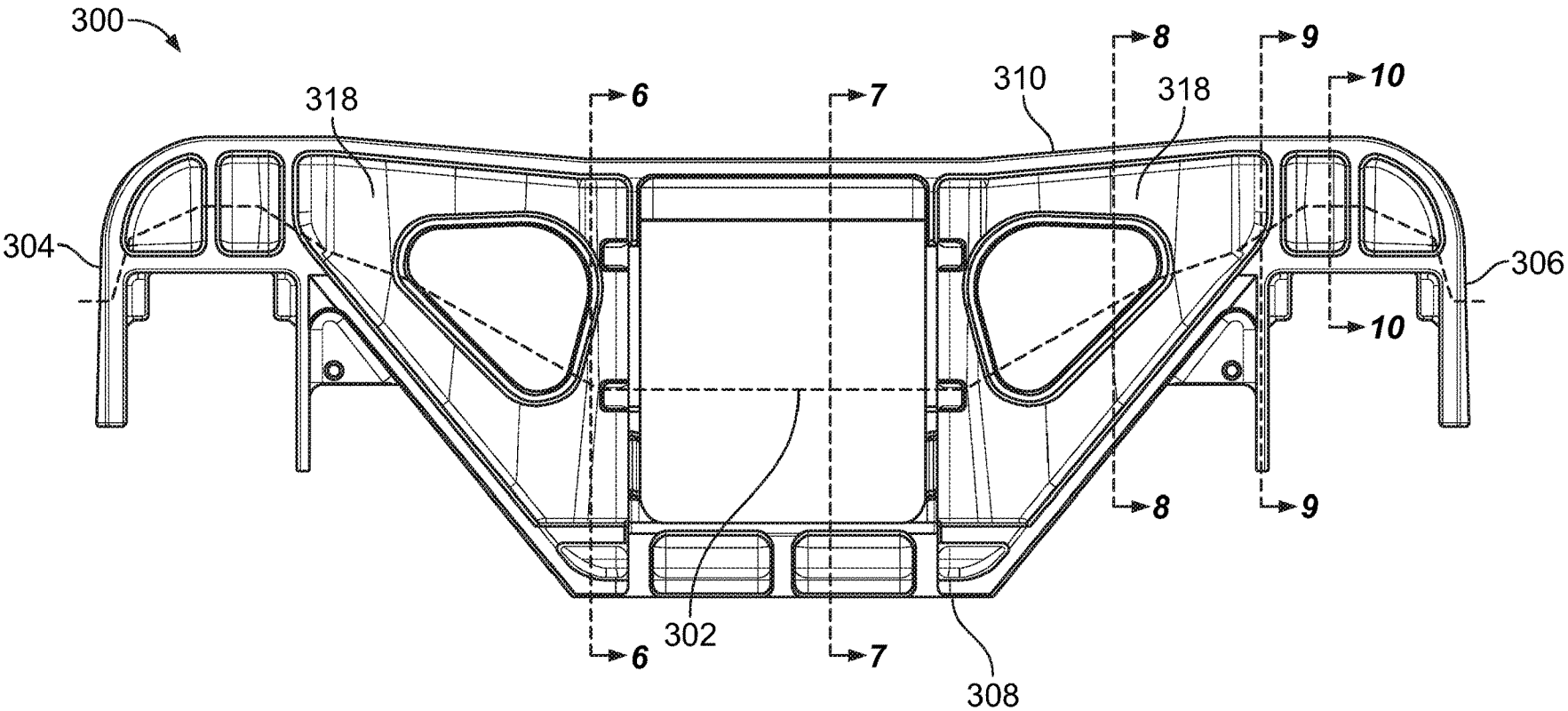
FIG. 4 illustrates a lateral view of the side frame.
Figure 5:
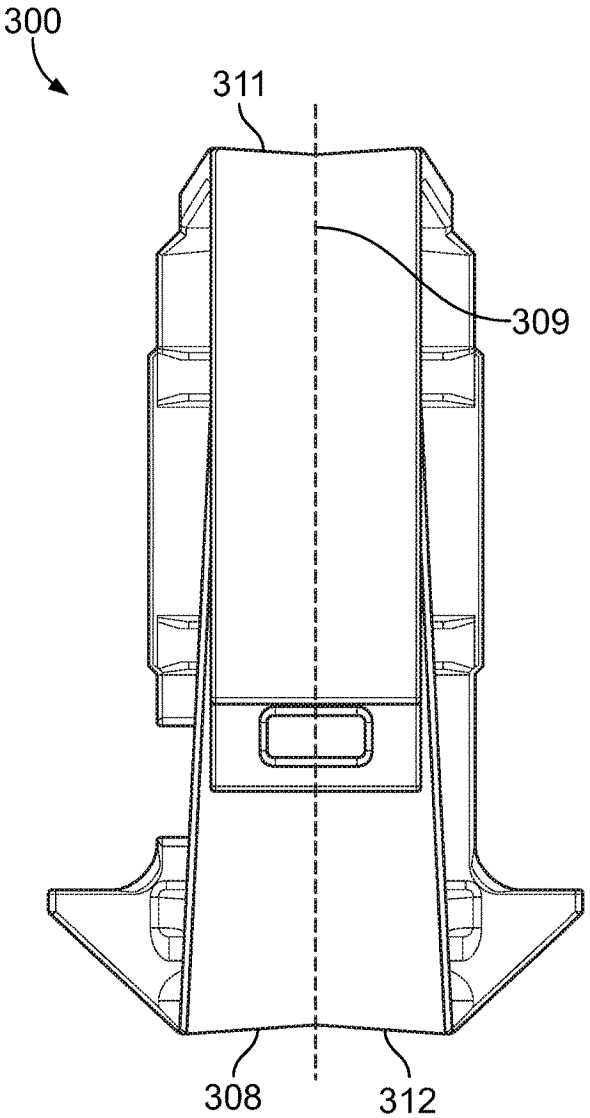
FIG. 5 illustrates an end view of the side frame.

FIG. 4 illustrates a lateral view of the side frame 300. FIG. 5 illustrates an end view of the side frame 300. Referring to FIGS. 4 and 5, a first neutral axis X 302 extends along a length of the side frame 300, such as from and between a first end 304 and a second end 306. A second neutral axis Y 309 is orthogonal to the first neutral axis X 302 and may extend along a length of the side frame 300 from and between a top 311 and a bottom 312. The neutral axis X 302 is the point where no bending occurs from vertical loads. In at least one embodiment, the neutral axis X 302 is the thinnest section of the webs 318. The tension members 308 and the compression members 310 may include outwardly-flared edges (that is, thicknesses increase away from the neutral axis Y 309).

The compression members 310 may provide a first flange of an I-beam construction, such as the first flange 204 of FIG. 2. The tension members 308 may provide a second flange of an I-beam construction, such as the second flange 206 of FIG. 2. The webs 318 may provide a web of an I-beam construction, such as the web 202 of FIG. 2. One or more features (such as channels, holes, protuberances, bends, and the like) may be formed in the compression members 310, the webs 318, and the tension members 308.

Figure 6:
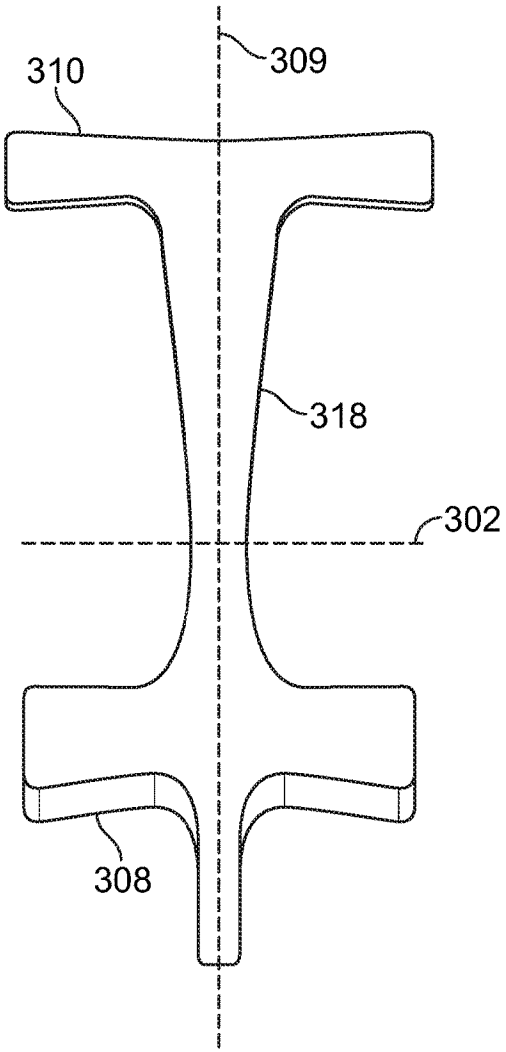
FIG. 6 illustrates a cross-sectional view of the side frame through line 6-6 of FIG. 4.

FIG. 6 illustrates a cross-sectional view of the side frame 300 through line 6-6 of FIG. 4. As shown, the side frame 300 is formed as an I-beam in which the web 318 outwardly expands (that is, increases in thickness) away from the neutral axis X 302 towards the tension member 308 and the compression member 310. Further, the tension member 308 and the compression member 310 outwardly expand (that is, increase in thickness) away from the neutral axis Y 309 towards distal edges.

Figure 10:
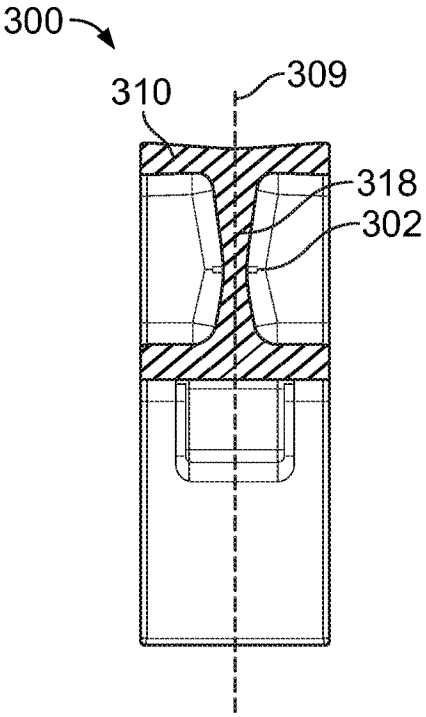
FIG. 10 illustrates a cross-sectional view of the side frame through line 10-10 of FIG. 4.
Figure 9:
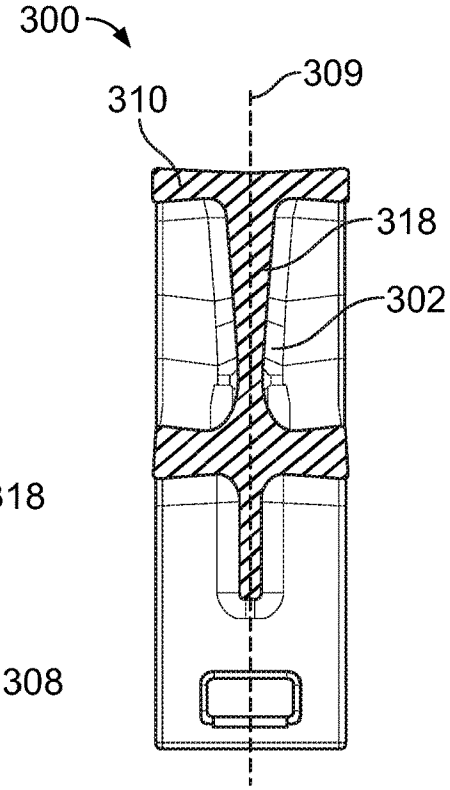
FIG. 9 illustrates a cross-sectional view of the side frame through line 9-9 of FIG. 4.
Figure 8:
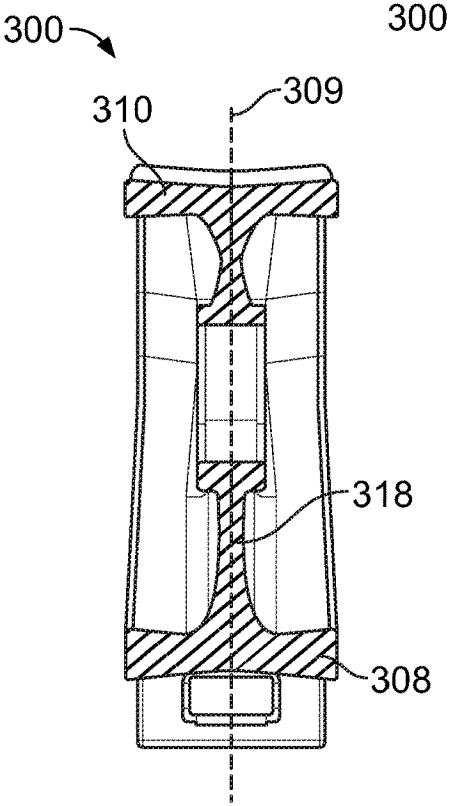
FIG. 8 illustrates a cross-sectional view of the side frame through line 8-8 of FIG. 4.
Figure 7:
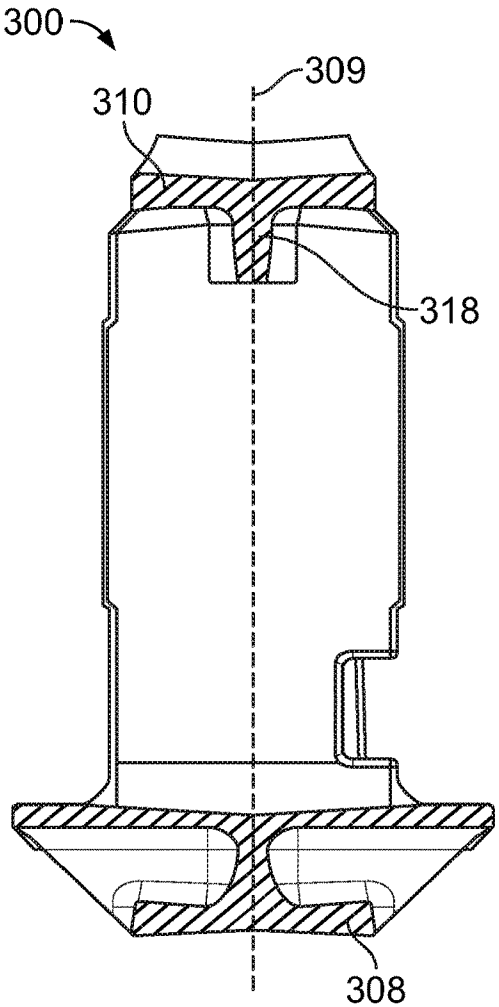
FIG. 7 illustrates a cross-sectional view of the side frame through line 7-7 of FIG. 4.

FIG. 7 illustrates a cross-sectional view of the side frame 300 through line 7-7 of FIG. 4. FIG. 8 illustrates a cross-sectional view of the side frame 300 through line 8-8 of FIG. 4. FIG. 9 illustrates a cross-sectional view of the side frame 300 through line 9-9 of FIG. 4. FIG. 10 illustrates a cross-sectional view of the side frame 300 through line 10-10 of FIG. 4. Referring to FIGS. 7-10, the web 318 is thinnest at and along neutral axis X 302, and outwardly expands away from the neutral axis X 302. Similarly, the tension member 308 and the compression member 310 outwardly expand away from the neutral axis Y 309.

As set forth herein, the constant stress side frame 300 provides several advantages over other side frames. For instance, the constant stress side frame 300 provides significant material and cost savings over other designs, because the manufacturing process involves less preparation and finish work. Moreover, the side frame 300 has surfaces that are more readily visible, allowing for a quicker and more accurate inspection. Moreover, the side frame 300 allows the manufacturing process to achieve greater accuracy in achieving the desired dimensions and tolerances, which can reduce or even eliminate the need to machine the finished product.

Portions of a truck assembly, such as the side frame 300, may be formed as an outwardly-expanding I-beam, as described herein. In at least one other embodiment, various other structures (such as brake guides, wear plates, portions of engine housings, and/or the like) may be formed as I-beams, as described herein.

Figure 11:
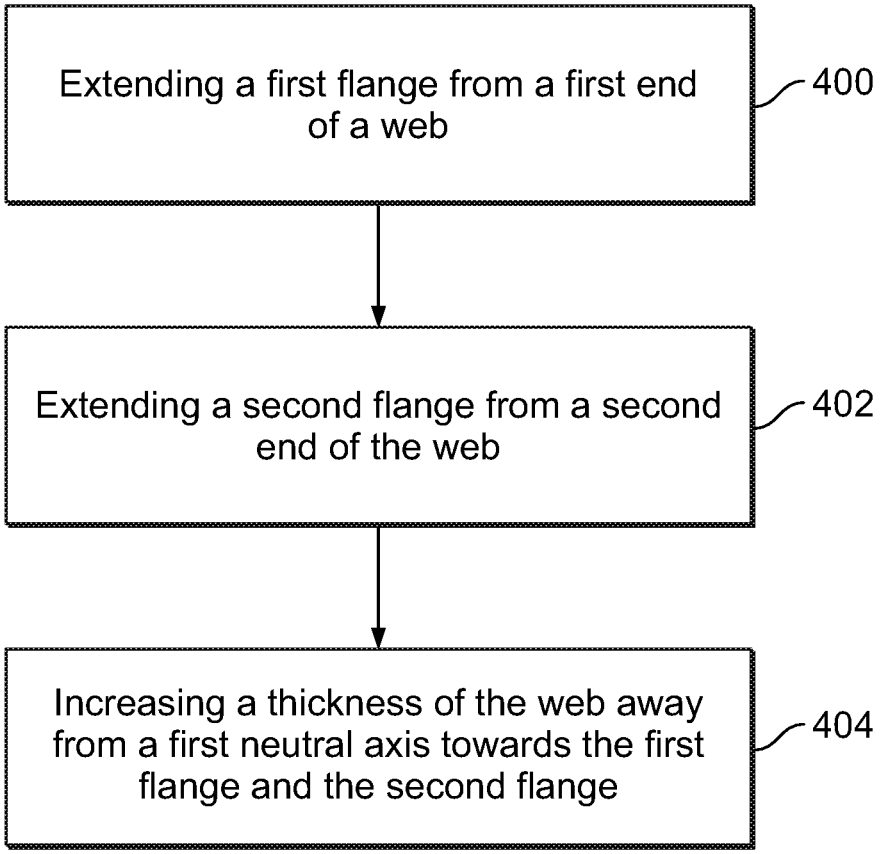
FIG. 11 illustrates a flow chart of a method of forming an I-beam, according to an embodiment of the present disclosure.

FIG. 11 illustrates a flow chart of a method of forming an I-beam, according to an embodiment of the present disclosure. The method include extending (400) a first flange from a first end of a web, extending (402) a second flange from a second end of the web (wherein the second end is opposite from the first end), and increasing (404) a thickness of the web away from a first neutral axis towards the first flange and the second flange.

The method may also include increasing a thickness of the first flange away from a second neutral axis towards first distal edges of the first flange. The method may also include increasing a thickness of the second flange away from the second neutral axis towards second distal edges of the second flange.

As described herein, embodiments of the present disclosure provide a railway truck assembly having components that may be efficiently formed. Further, embodiments of the present disclosure provide a railway truck assembly having components that are robust and reliable. Moreover, embodiments of the present disclosure provide I-beams that that efficiently carry bending and shear loads in a plane of a web, as well as an increased capacity in a transverse direction.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. An I-beam comprising:

a web having a first end and a second end opposite from the first end;

a first flange extending from the first end of the web; and a second flange extending from the second end of the web, wherein a first neutral axis is between the first flange and the second flange, wherein a thickness of the web uniformly increases away from the first neutral axis towards the first flange and the second flange, and wherein outer surfaces of the web have a constant outward slope or curvature from and away the first neutral axis towards the first flange and the second flange.

2. The I-beam of claim 1, wherein the web at the first neutral axis is a thinnest portion of the web.

3. The I-beam of claim 1, wherein a second neutral axis is between first distal edges of the first flange, and wherein a thickness of the first flange increases away from the second neutral axis towards first distal edges of the first flange.

4. The I-beam of claim 3, wherein the first neutral axis is orthogonal to the second neutral axis.

5. The I-beam of claim 3, wherein the first flange at the second neutral axis is a thinnest portion of the first flange.

6. The I-beam of claim 3, wherein the second neutral axis also between second distal edges of the second flange, and wherein a thickness of the second flange increases away from the second neutral axis towards second distal edges of the second flange.

7. The I-beam of claim 6, wherein the second flange at the second neutral axis is a thinnest portion of the second flange.

8. A method of forming an I-beam, the method comprising:

extending a first flange from a first end of a web;

extending a second flange from a second end of the web, wherein the second end is opposite from the first end; and uniformly increasing a thickness of the web away from a first neutral axis towards the first flange and the second flange, wherein the first neutral axis is between the first flange and the second flange, wherein said uniformly increasing comprises providing outer surfaces of the web with a constant slope or curvature from and away the first neutral axis towards the first flange and the second flange.

9. The method of claim 8, wherein said uniformly increasing comprises forming a thinnest portion of the web at the first neutral axis.

10. The method of claim 8, further comprising increasing a thickness of the first flange away from a second neutral axis towards first distal edges of the first flange, wherein the second neutral axis is between the first distal edges of the first flange.

11. The method of claim 10, wherein said increasing the thickness of the first flange comprises forming a thinnest portion of the first flange at the second neutral axis.

12. The method of claim 10, further comprising increasing a thickness of the second flange away from the second neutral axis towards second distal edges of the second flange, wherein the second neutral axis is between the second distal edges of the second flange.

13. The method of claim 12, wherein said increasing the thickness of the second flange comprises forming a thinnest portion of the second flange at the second neutral axis.

14. A truck assembly that is configured to travel along a track having rails, the truck assembly comprising:

a first side frame;

a second side frame; and a bolster extending between the first side frame and the second side frame, wherein one or more of the first side frame, the second frame, or the bolster includes at least a portion formed as an I-beam, the I-beam comprising:

a web having a first end and a second end opposite from the first end;

a first flange extending from the first end of the web; and a second flange extending from the second end of the web, wherein a first neutral axis is between the first flange and the second flange, wherein a thickness of the web uniformly increases away from the first neutral axis towards the first flange and the second flange, and wherein outer surfaces of the web have a constant outward slope or curvature from and away the first neutral axis towards the first flange and the second flange.

15. The truck assembly of claim 14, wherein the web at the first neutral axis is a thinnest portion of the web.

16. The truck assembly of claim 14, wherein a second neutral axis is between first distal edges of the first flange, and wherein a thickness of the first flange increases away from the second neutral axis towards first distal edges of the first flange.

17. The truck assembly of claim 16, wherein the second neutral axis is between second distal edges of the second flange, and wherein a thickness of the second flange increases away from the second neutral axis towards the second distal edges of the second flange.

* * * * *